United States Patent [19]

Patrick et al.

[11] Patent Number: 4,994,123

[45] Date of Patent: Feb. 19, 1991

[54] POLYMERIC INTERMOLECULAR EMULSION EXPLOSIVE

[75] Inventors: Michael A. Patrick, Shalimar, Fla.; Sara J. Massey, Miamisburg, Ohio

[73] Assignee: The United States of America as represented by the Secretary of the Air Force, Washington, D.C.

[21] Appl. No.: 529,413

[22] Filed: May 29, 1990

[51] Int. Cl.[5] ..... C06B 45/00

[52] U.S. Cl. ..... 149/2; 149/45; 149/46; 149/47; 149/61; 149/62; 149/70; 149/75; 149/76; 149/83; 149/85; 149/88; 149/92

[58] Field of Search ..... 149/2, 46, 45, 61, 47, 149/62, 70, 76, 75, 83, 85, 88, 92

[56] References Cited

U.S. PATENT DOCUMENTS

| | | | |
|---|---|---|---|
| 3,914,141 | 10/1975 | Sayles | 149/19.3 |
| 3,957,549 | 5/1976 | Baldwin | 149/19.91 |
| 4,112,849 | 9/1978 | Jones | 42/00 |
| 4,343,664 | 8/1982 | Iyer | 149/11 |
| 4,496,405 | 1/1985 | Cechanski | 149/2 |
| 4,525,225 | 6/1985 | Cechanski | 149/2 |
| 4,632,714 | 12/1986 | Abegg et al. | 149/2 |
| 4,655,859 | 4/1987 | Sayles | 149/19.2 |

*Primary Examiner*—Stephen J. Lechert, Jr.

*Attorney, Agent, or Firm*—Charles E. Bricker; Donald J. Singer

[57] ABSTRACT

A physically stable emulsion explosive composition consisting of a dispersed phase and a continuous phase, wherein the dispersed phase consists essentially of at least one oxidizing compound and at least one fuel compound, and wherein the continuous phase consists essentially of a polyacrylate resin.

9 Claims, No Drawings

POLYMERIC INTERMOLECULAR EMULSION EXPLOSIVE

RIGHTS OF THE GOVERNMENT

The invention described herein may be manufactured and used by or for the Government of the United States for all governmental purposes without the payment of any royalty.

BACKGROUND OF THE INVENTION

This invention relates to explosives, particularly to explosive compositions based upon ammonium nitrate.

Traditional general-purpose explosives comprise trinitrotoluene (TNT), which has several disadvantages. It is a Class-A explosive, requiring special mixing and handling procedures and storage facilities, all accordingly increasing the cost of use. The preparation of this explosive is through nitrate substitution of toluene by a mixed acid consisting of concentrated nitric acid and sulphuric acid. The cost of concentrated nitric acid is moderately expensive and any excess nitric acid in the product destabilizes the explosive and presents corrosion problems. Trinitrotoluene is not water soluble and bomb disposal cannot be done economically by steam or hot water.

It is known to produce cast high explosive compositions by solidification of a molten mixture of ammonium nitrate (AN) and ethylenediamine dinitrate (EDDN). A binary mixture of ethylenediamine dinitrate and ammonium nitrate is water soluble, thereby having several advantages over trinitrotoluene such as safer storage as a non-explosive water solution and cheaper disposal. However, the binary mixture has a high melting point, has stability problems, and is expensive.

It is known to add potassium nitrate (KN) to the AN/EDDN mixture to improve its stability. The problems associated with the binary mixture remain and the amount of chloride impurities is increased by the additional chloride impurities found in potassium nitrate (KN). If these impurities are not removed, the explosive has serious corrosion problems. If the impurities are removed the cost of the explosive increases greatly. The present method of making the ternary mixture is to mix solid ethylenediamine dinitrate, ammonium nitrate and potassium nitrate. Ethylenediamine dinitrate is not commercially available in large quantities and is expensive. Industrial grade ammonium nitrate and potassium nitrate are too impure to be used without the additional expense of purification. Dry mixing three explosives to form an explosive mixture requires special procedures and precautions, causing the cost of the process to increase significantly.

Other explosives compositions based upon ammonium nitrate include AN/TNT/RDX (cyclotrimethylenetrinitramine), AN/EDDN/KN/NQ (nitroguanidine) and the like.

Ammonium nitrate is a hazardous material to manufacture on an industrial scale, to handle in large amounts, and to store in great masses, especially for relatively long periods of time. The shock sensitivity of ammonium nitrate increases seriously after exposure to a few temperature cycles through the 32.3° C. (90° F.) transition point of AN. (Up to 32.3° C. the stable crystal form is orthorhombic bipyrimidal; from 32.3° C. to 84° C. the stable crystal form is orthorhombic). Further, emulsion explosives demulsify when either the continuous or discontinuous phase melt temperature is reached or exceeded, with subsequent loss of desirable properties.

Accordingly, it is an object of this invention to provide a novel explosive composition based upon ammonium nitrate.

Other objects and advantages of the present invention will be apparent to those skilled in the art from a reading of the following description of the invention.

SUMMARY OF THE INVENTION

In accordance with the present invention there is provided a physically stable emulsion explosive composition consisting of a dispersed phase and a continuous phase, wherein the dispersed phase consists essentially of at least one oxidizing compound and at least one fuel compound, and wherein the continuous phase consists essentially of a polyacrylate resin.

DESCRIPTION OF THE PREFERRED EMBODIMENT

The explosive compositions of this invention consist of about 5 to 20 wt. % continuous phase, balance dispersed phase. The dispersed phase consists essentially of at least one oxidizing compound and at least one fuel compound. Oxidizing compounds which may be used in the compositions of the invention include the nitrate, chlorate and perchlorate salts of lithium, sodium, potassium, magnesium, calcium, strontium, barium, copper, zinc, manganese, lead and their ammonium counterparts, including mixtures thereof. Examples of fuel compounds include the nitrate or perchlorate adducts of ethanolamine, ethylenediamine and higher homologs; aliphatic amides such as formamide, acetamide and urea; urea nitrate and urea perchlorate; nitroguanidine, guanidine nitrate and perchlorate, and triaminoguanidine nitrate and perchlorate; polyols such as ethylene glycol, glycerol, and higher homologs; ammonium and metal salts of carboxylic acids such as formic and acetic and higher acids; sulfur-containing compounds such as dimethylsulfoxide; and mixtures thereof. The dispersed phase is preferably a eutectic composition of oxidizer and fuel components, e.g., an approximately 50:50 mixture of ammonium nitrate and ethylenediaminedinitrate.

The continuous phase is a polymer formed by the polymerization of a monomer or mixture of monomers having a boiling point or boiling range at or above the melt temperature of the oxidizer/fuel composition. Suitable monomers include acrylate esters, e.g., ethyl acrylate, butyl acrylate, trimethylol propane trimethacrylate, methyl methacrylate, 2-ethyl-hexyl acrylate, isobornyl methacrylate, and the like.

The compositions of this invention are prepared by first forming a melt of oxidizer and fuel. Once these components are in the melt state, the monomer or monomer mixture is added and the resulting mixture is subjected to high shear mixing to emulsify the dispersed phase in the continuous phase. One or more emulsion promoters may be added to the mixture to improve or accomplish emulsification. Suitable emulsion promoters include cationic surfactants such as ethoxylated alkylamines, alkylamines or their salts. Additional cationic or non-ionic surfactants may be added to improve emulsion formation, viscosity, stability or hydrophilic/lipophilic balance (HLB). The mixture may also include other known polymer additives, such as antioxidants and the like.

Polymerization is effected by adding one or more catalysts of the free radical type, such as organic peroxides, hydroperoxides or azo compounds, e.g., 2,5-dimethyl-2,5-bis(t-butylperoxy)hexane, diepoxydicyclohexyl carboxylate, or the like. It is presently preferred to also add at least one crosslinking agent, such as 2-ethyl-2-hydroxymethyl-1,3-propanediol triacrylate. The polymerization is exothermic; accordingly, polymerization temperature must be controlled. The polymerization is particularly sensitive to the presence of oxygen, which can retard the polymerization process, as well as alter the polymer composition and/or molecular weight. The physical and thermal properties of the continuous phase can be varied by appropriate selection of monomers, the use of polyfunctional crosslinking agents, the type and concentration of polymerization initiators, and optimization of curing temperature.

The resulting emulsion explosive composition can be cast into a suitable mold, such as general purpose bomb, submunitions, shaped charges, or missile warheads.

The following example illustrates the invention:

EXAMPLE

An explosive composition was prepared according to the following recipe:

| Compound | Wt % |
|---|---|
| Ammonium nitrate | 39.1 |
| Ethylenediaminedinitrate | 39.1 |
| Potassium Nitrate | 6.8 |
| Isobornyl methacrylate | 11.52 |
| Polymerization catalyst[1] | 0.12 |
| Crosslinking agent[2] | 0.36 |
| Emulsion promoter[3] | 2.0 |
| Polymer dispersing agent[4] | 1.0 |

[1]Lupersol 101 (90% 2,5-dimethyl-2,5-bis(t-butyl-peroxy)hexane)
[2]2-ethyl-2-hydroxymethyl-1,3-propanediol triacrylate
[3]Soya amine acetate
[4]Hypomer 246

The resulting composition was cast into a suitable mold and allowed to polymerize and cool.

Various modifications may be made to the invention as described without departing from the spirit of the invention or the scope of the appended claims.

We claim:

1. An emulsion explosive composition consisting of a dispersed phase and a continuous phase, wherein the dispersed phase consists essentially of at least one oxidizing compound and at least one fuel compound, and wherein the continuous phase consists essentially of a polyacrylate resin.

2. The explosive composition of claim 1 wherein said oxidizing compound is selected from the group consisting of the nitrates, chlorates and perchlorates of lithium, sodium, potassium, magnesium, calcium, strontium, barium, copper, zinc, manganese, lead, ammonium, and mixtures thereof.

3. The explosive composition of claim 2 wherein said oxidizing compound is ammonium nitrate.

4. The explosive composition of claim 1 wherein said fuel compound is selected from the group consisting of the nitrate or perchlorate adducts of ethanolamine, ethylenediamine and higher homologs; aliphatic amides; urea nitrate and urea perchlorate; nitroguanidine, guanidine nitrate and perchlorate, and triaminoguanidine nitrate and perchlorate; polyols and higher homologs; ammonium and metal salts of carboxylic acids; sulfur-containing compounds; and mixtures thereof.

5. The explosive composition of claim 4 wherein said fuel compound is ethylenediaminedinitrate.

6. The explosive composition of claim 1 wherein said oxidizing compound is ammonium nitrate and said fuel compound is ethylenediaminedinitrate.

7. The explosive composition of claim 6 wherein the composition of said oxidizing compound and said fuel compound is eutectic.

8. The explosive composition of claim 1 wherein said polyacrylate resin is isobornyl methacrylate.

9. The explosive composition of claim 1 wherein said continuous phase is about 5 to 20 wt. % of said composition, balance dispersed phase.

* * * * *